US006553627B1

(12) United States Patent
Horler

(10) Patent No.: US 6,553,627 B1
(45) Date of Patent: Apr. 29, 2003

(54) HANDLE ASSEMBLY FOR A TOOL

(76) Inventor: Clifford J. Horler, 8 High Ridge Rd., Montvale, NJ (US) 07645

( * ) Notice: Subject to any disclaimer, the term of this patent is extended or adjusted under 35 U.S.C. 154(b) by 71 days.

(21) Appl. No.: 09/671,903

(22) Filed: Sep. 28, 2000

(51) Int. Cl.[7] ..... A47B 95/02

(52) U.S. Cl. ..... 16/426; 16/427; 294/58; 15/144.1

(58) Field of Search ..... 16/426, 427, 406; 294/58, 59, 57, 54.5; 15/144.1, 145

(56) References Cited

U.S. PATENT DOCUMENTS 237,891 A * 2/1881 Musselman
607,154 A * 7/1898 Berck
1,083,054 A * 12/1913 Brown
1,687,190 A * 10/1928 Wulff
3,466,078 A * 9/1969 Sholund
4,225,104 A * 9/1980 Larson
4,276,675 A * 7/1981 Pioch
4,484,255 A * 11/1984 Warshawsky
5,352,060 A 10/1994 Poetker
5,594,975 A 1/1997 Christen
5,625,922 A 5/1997 Morad
5,669,101 A 9/1997 Aiyama et al.
5,695,231 A 12/1997 Hoffman
D401,833 S 12/1998 Whitehead
5,870,800 A * 2/1999 Chao

* cited by examiner

*Primary Examiner*—Gary Estremsky
*Assistant Examiner*—Mark Williams

(57) ABSTRACT

A handle assembly for a tool for providing an ergonomic handle designed to minimize back strain and injury. The handle assembly for a tool includes a main member with a gripping portion, a connection assembly which extends from the main member and includes a pair of opposing connection arms, and a locking assembly couplable to the opposing connection arms for clamping the opposing connection arms to an elongated rod handle of a tool.

1 Claim, 5 Drawing Sheets

HANDLE ASSEMBLY FOR A TOOL

BACKGROUND OF THE INVENTION

1. Field of the Invention

The present invention relates to handles and more particularly pertains to a new handle assembly for a tool for providing an ergonomic handle designed to minimize back strain and injury.

2. Description of the Prior Art

The use of handles is known in the prior art. More specifically, handles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,594,975; 5,695,231; 5,669,101; 5,352,060; 5,625,922; and U.S. Pat. No. Des. 401,833.

While these devices fulfill their respective, particular objectives and requirements, the aforementioned patents do not disclose a new handle assembly for a tool. The inventive device includes a main member with a gripping portion, a connection assembly which extends from the main member and includes a pair of opposing connection arms, and a locking assembly couplable to the opposing connection arms for clamping the opposing connection arms to an elongated rod handle of a tool.

In these respects, the handle assembly for a tool according to the present invention substantially departs from the conventional concepts and designs of the prior art, and in so doing provides an apparatus primarily developed for the purpose of providing an ergonomic handle designed to minimize back strain and injury.

SUMMARY OF THE INVENTION

In view of the foregoing disadvantages inherent in the known types of handles now present in the prior art, the present invention provides a new handle assembly for a tool construction wherein the same can be utilized for providing an ergonomic handle designed to minimize back strain and injury.

The general purpose of the present invention, which will be described subsequently in greater detail, is to provide a new handle assembly for a tool apparatus and method which has many of the advantages of the handles mentioned heretofore and many novel features that result in a new handle assembly for a tool which is not anticipated, rendered obvious, suggested, or even implied by any of the prior art handles, either alone or in any combination thereof.

To attain this, the present invention generally comprises a main member with a gripping portion, a connection assembly which extends from the main member and includes a pair of opposing connection arms, and a locking assembly couplable to the opposing connection arms for clamping the opposing connection arms to an elongated rod handle of a tool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handle assembly for a tool apparatus and method which has many of the advantages of the handles mentioned heretofore and many novel features that result in a new handle assembly for a tool which is not anticipated, rendered obvious, suggested, or even implied by any of the prior art handles, either alone or in any combination thereof.

It is another object of the present invention to provide a new handle assembly for a tool which may be easily and efficiently manufactured and marketed.

It is a further object of the present invention to provide a new handle assembly for a tool which is of a durable and reliable construction.

An even further object of the present invention is to provide a new handle assembly for a tool which is susceptible of a low cost of manufacture with regard to both materials and labor, and which accordingly is then susceptible of low prices of sale to the consuming public, thereby making such handle assembly for a tool economically available to the buying public.

Still yet another object of the present invention is to provide a new handle assembly for a tool which provides in the apparatuses and methods of the prior art some of the advantages thereof, while simultaneously overcoming some of the disadvantages normally associated therewith.

Still another object of the present invention is to provide a new handle assembly for a tool for providing an ergonomic handle designed to minimize back strain and injury.

Yet another object of the present invention is to provide a new handle assembly for a tool which includes a main member with a gripping portion, a connection assembly which extends from the main member and includes a pair of opposing connection arms, and a locking assembly couplable to the opposing connection arms for clamping the opposing connection arms to an elongated rod handle of a tool.

Still yet another object of the present invention is to provide a new handle assembly for a tool that can be fit onto any common household gardening tool.

Even still another object of the present invention is to provide a new handle assembly for a tool that can be positioned to fit the individual requirements of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
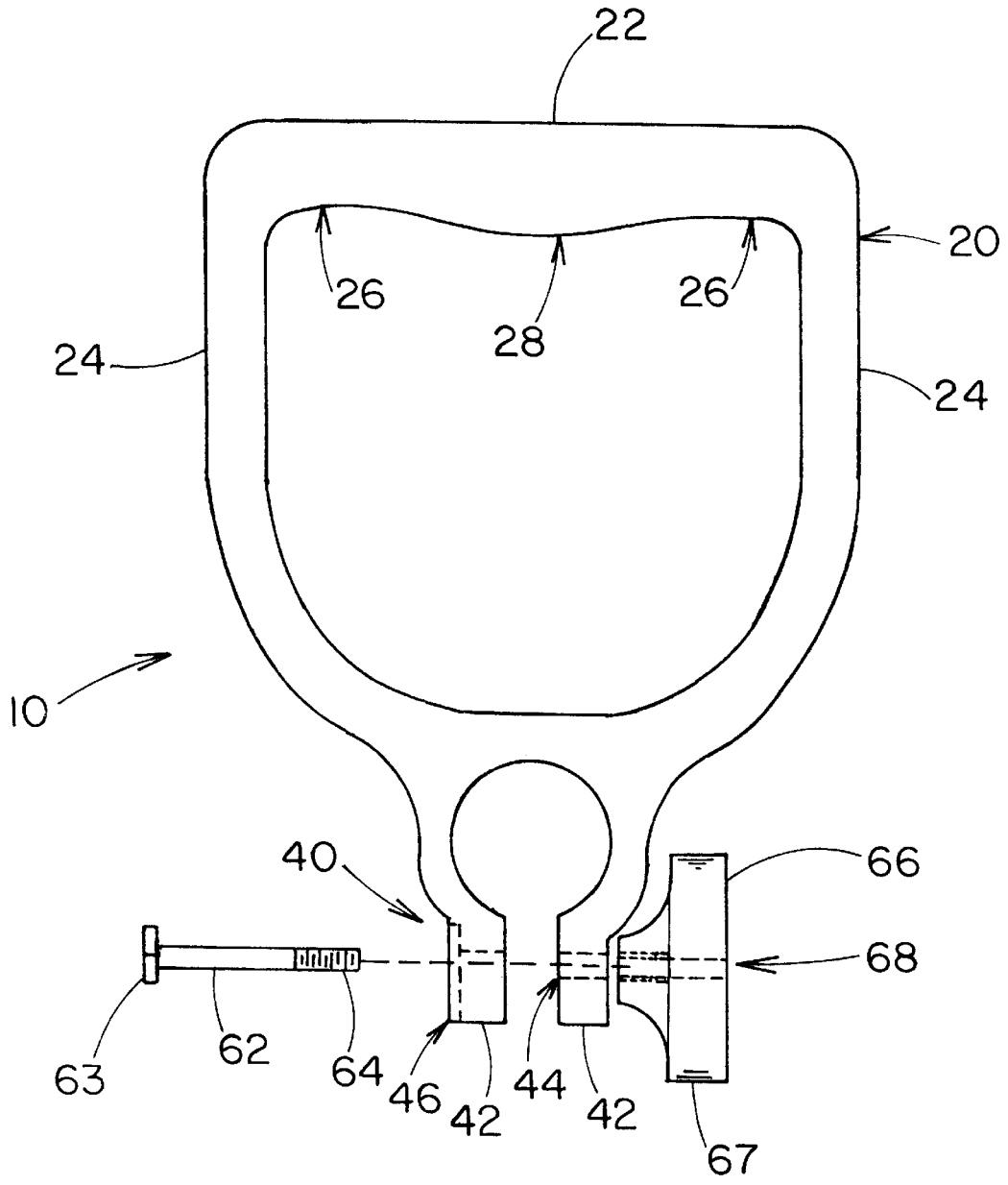
FIG. 1 is a schematic front view of a new handle assembly for a tool according to the present invention.
Figure 2:
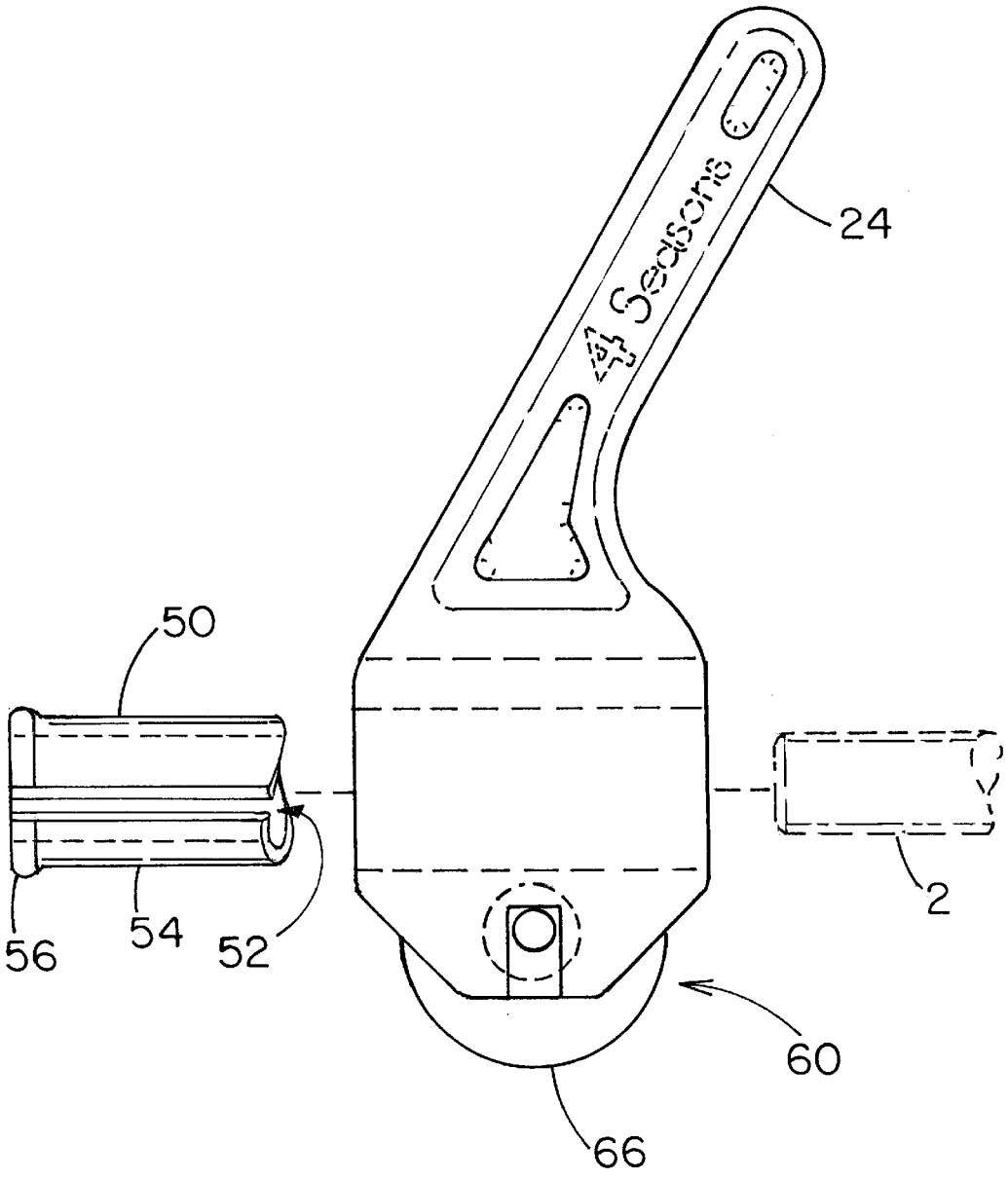
FIG. 2 is a schematic side view of the present invention.
Figure 3:
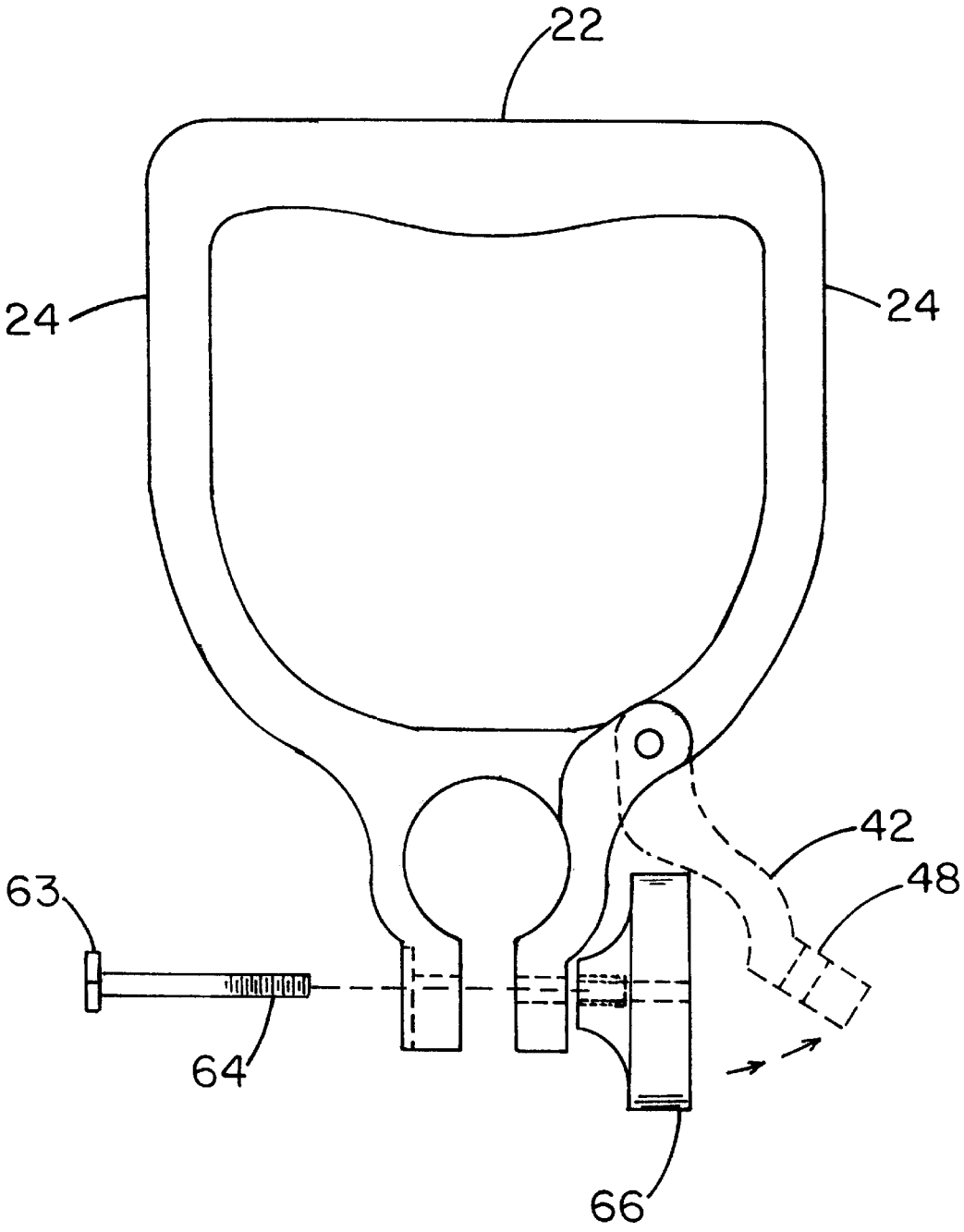
FIG. 3 is a schematic front view of an embodiment of the present invention.
Figure 4:
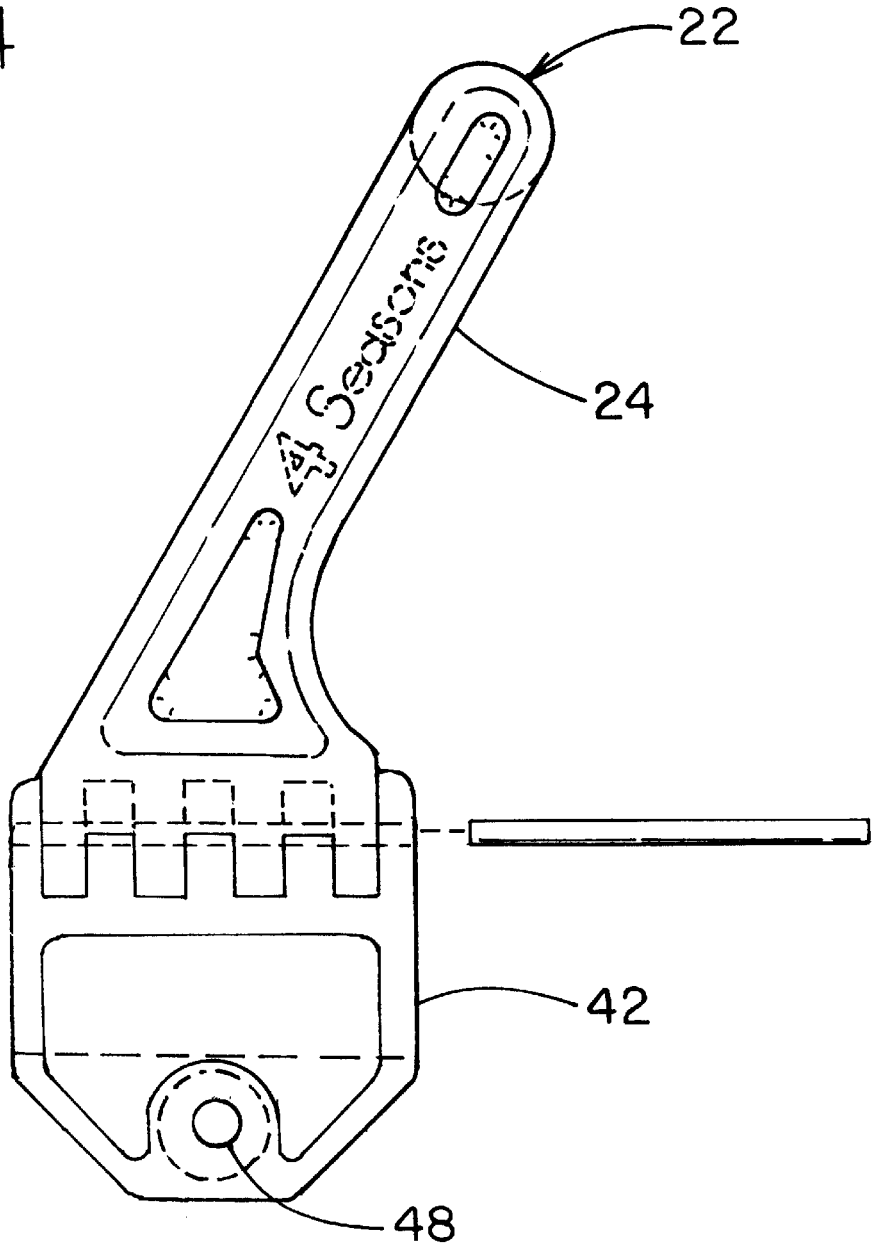
FIG. 4 is a schematic side view of an embodiment of the present invention.
Figure 5:
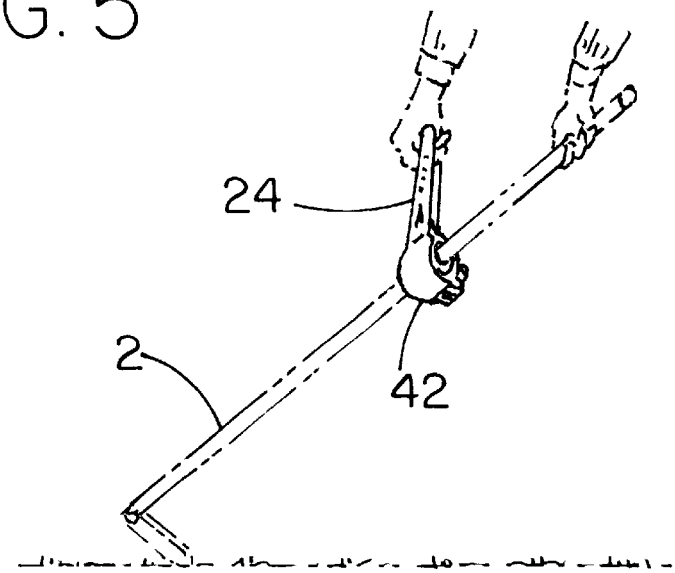
FIG. 5 is a schematic perspective view of the present invention in use.
Figure 6:
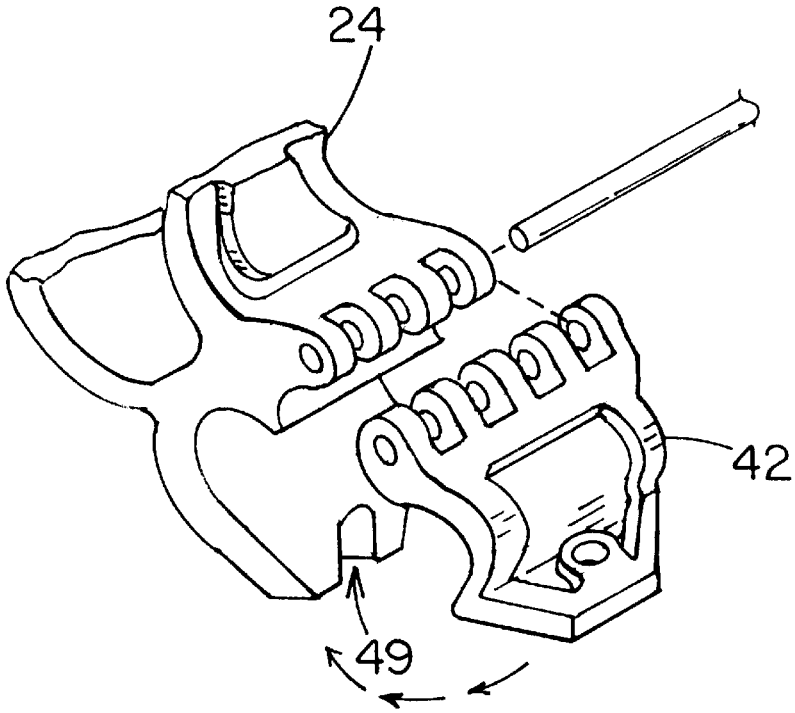
FIG. 6 is a schematic detail view of the pivotal coupling portion of the present invention.

With reference now to the drawings, and in particular to FIGS. 1 through 6 thereof, a new handle assembly for a tool embodying the principles and concepts of the present invention and generally designated by the reference numeral 10 will be described.

As best illustrated in FIGS. 1 through 6, the handle assembly for a tool 10 generally comprises a main member 20, a connection assembly 40, and a locking assembly 60.

The main member 20 includes a gripping portion 22.

The connection assembly 40 extends from the main member 20. The connection assembly 40 includes a pair of opposing connection arms 42.

The locking assembly 60 is coupled to the opposing connection arms 42 for clamping the opposing connection arms 42 to the elongated rod handle 2 of the tool. Thus the main member 20 is coupled to the shaft 2 of the tool.

The main member 20 includes a pair of spaced side members 24. The gripping portion 22 extends between distal ends of the side portions 24.

The side portions 24 are positioned such that a longitudinal axis of the grip 22 extends transverse to a longitudinal axis of the shaft 2 of the tool when the connection portion 40 is coupled to the shaft 2.

The grip 22 includes a pair of outer portions 26 and a medial portion 28 positioned between the outer portions 26.

The medial portion 38 is curved such that an area of a transverse cross-section of the medial portion 28 is greater than an area of a transverse cross-section of each of the outer portions 26 for facilitating gripping of the grip 22 by a human hand.

Each one of a pair of clamping aperture 44 extends through an associated one of the connection arms 42.

The locking assembly 60 includes a connector 62 with a head portion 63 and a rod portion 64. A distal end of the rod portion 64 is threaded. The rod portion 64 of the connector 62 is insertable through the clamping apertures 44.

The locking assembly 60 includes a tightening member 66 with a threaded aperture 68 extending through the tightening member 66. The threaded aperture 68 is for threadedly receiving the distal end of the connector 62. Thus the connection arms 44 are compressible between the head portion 63 of the connector 62 and the tightening member 66 when the tightening member 66 is engaged to the distal end of the connector 62 and the tightening member 66 is rotated in a first direction relative to the connector 62. Thus the connection arms 44 can be urged into contact with the shaft 2 of the tool for coupling the main member 20 to the shaft 2 of the tool.

The tightening member 66 includes a knurled outer perimeter 67 for facilitating gripping and rotation of the tightening member 66.

The head portion 63 includes a straight outer edge.

A first one of the connection arms 42 includes a recess 46 for receiving the head portion 63 of the connector 62 when the connector 62 is fully inserted through the clamping apertures 44 such that the straight outer edge of the head portion 63 extends along a straight edge of the recess 46 for preventing rotation of the connector 62 relative to the first one of the connection arms 42 when the connector 62 is fully inserted through the clamping apertures 44.

A sleeve member 50 is designed for coupling around the shaft 2 of the tool. The sleeve member 50 is positionable between the connection arms 42 such that the sleeve member 50 is clampable between the connection arms 42. Thus the sleeve member 50 frictionally engages the shaft 2 of the tool. Thus the main member 20 is coupled to the shaft 2 of the tool.

An angled split 52 extends through a wall of the sleeve member 50 for facilitating compression of the sleeve member 50 around the shaft 2 of the tool when the connection arms 42 are urged together by the locking assembly 60.

A medial extent 54 of the sleeve member 50 includes an outer diameter less than an outer diameter of each of a pair of outer extents 56 of the sleeve member 50.

The connection arms 42 are positionable around the medial extent 54 of the sleeve member 50 such that the outer extents 56 prevent the sleeve member 50 from slipping out from between the connection arms 42.

In an embodiment, one of the connection arms 42 is pivotally coupled to the main member 20 for facilitating positioning of the shaft 2 of the tool between the connection arms 42. A first one of the connection arms 42 includes a clamping slot 48 and a second one of the connection arms 42 includes a clamping aperture 44. The second one of the connection arms 42 is pivotally coupled to the main member 20. The rod portion 64 of the connector 62 is positionable to extend through the clamping slot 48 and the clamping aperture 44. The first one of the connection arms 42 includes a recessed slot 49 aligned with the connection slot 48. The recessed slot 49 is for receiving the head portion 63 of the connector 62 when the connector 62 is inserted through the clamping aperture 44 such that the straight outer edge of the head portion 63 extends along a straight edge of the recess 46 for preventing rotation of the connector 62 relative to the first one of the connection arms 42 when the connector 62 is inserted through the clamping aperture 44.

In use, the handle assembly is placed around the shaft of a tool. The connection arms arm urged together by the locking assembly. If desired the sleeve member is positioned over the shaft of the tool prior to applying the handle assembly. The tool is the used with a modified two handed grip.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handle assembly for adjustably coupling to a tool having an elongated rod handle, said handle assembly comprising;

a main member forming a continuous closed loop and having a gripping portion;

a connection assembly extending from said main member, said connection assembly including a pair of opposing connection arms;

a locking assembly couplable to said opposing connection arms for clamping said opposing connection arms to the elongated rod handle of the tool whereby said main member is coupled to a shaft of the tool;

said main member including a pair of spaced side members, said gripping portion extending between distal ends of said side portions;

said side portions being positioned such that a longitudinal axis of said grip extends transverse to a longitudinal axis of the shaft of the tool when the connection portion is coupled to the shaft;

said grip having a pair of outer portions and a medial portion positioned between said outer portions;

said medial portion being curved such that an area of a transverse cross-section of said medial portion is greater than an area of a transverse cross-section of each of said outer portions for facilitating gripping of said grip by a human hand;

one of said connection arms being pivotally coupled to said main member in a manner permitting pivoting of said one connection arms with respect to said main member about an axis extending substantially parallel to an axis of the shaft of the tool for facilitating positioning of the shaft of the tool between said connection arms;

a pair of clamping apertures, each clamping aperture extending through an associated one of said connection arms;

said locking assembly including a connector having a head portion and a rod portion, a distal end of said rod portion being threaded, said rod portion of said connector being insertable through said clamping apertures;

said locking assembly including a tightening member having a threaded aperture extending through said tightening member, said threaded aperture being for threadedly receiving said distal end of said connector whereby said connection arms are compressible between said head portion of said connector and said tightening member when said tightening member is engaged to said distal end of said connector and said tightening member is rotated in a first direction relative to said connector whereby said connection arms are urgable into contact with the shaft of the tool for coupling said main member to the shaft of the tool;

said tightening member having a knurled outer perimeter for facilitating gripping and rotation of said tightening member;

said head portion having a straight outer edge;

a first one of said connection arms having a recess for receiving said head portion of said connector when said connector is fully inserted through said clamping apertures such that said straight outer edge of said head portion extends along a straight edge of said recess for preventing rotation of said connector relative to said first one of said connection arms when said connector is fully inserted through said clamping apertures;

a sleeve member adapted for coupling around the shaft of the tool, said sleeve member being removably positionable between said connection arms and the shaft of the tool such that said sleeve member is clampable between said connection arms whereby said sleeve member frictionally engages the shaft of the tool whereby said main member is coupled to the shaft of the tool;

an angled split extending through a wall of said sleeve member for facilitating compression of said sleeve member around the shaft of the tool when said connection arms are urged together by said locking assembly;

a medial extent of said sleeve member having an outer diameter less than an outer diameter of each of a pair of outer extents of said sleeve member;

said connection arms being positionable around said medial extent of said sleeve member such that said outer extents prevent said sleeve member from slipping out from between said connection arms;

a first one of said connection arms including a clamping slot and a second one of said connection arms including a clamping aperture;

said one of said connection arms being pivotally coupled to said main member being said second one of said connection arms;

said locking assembly including a connector having a head portion and a rod portion, a distal end of said rod portion being threaded, said rod portion of said connector being positionable to extend through said clamping slot and said clamping aperture;

said locking assembly including a tightening member having a threaded aperture extending through said tightening member, said threaded aperture being for threadedly receiving said distal end of said connector whereby said connection arms are compressible between said head portion of said connector and said tightening member when said tightening member is engaged to said distal end of said connector and said tightening member is rotated in a first direction relative to said connector whereby said connection arms are urgable into contact with the shaft of the tool for coupling said main member to the shaft of the tool;

said head portion having a straight outer edge;

said first one of said connection arms having a recessed slot aligned with said connection slot, said recessed slot being for receiving said head portion of said connector when said connector is inserted through said clamping aperture such that said straight outer edge of said head portion extends along a straight edge of said recess for preventing rotation of said connector relative to said first one of said connection arms when said connector is inserted through said clamping aperture.

* * * * *